US006138653A

United States Patent [19]

Juffinger

[11] Patent Number: 6,138,653

[45] Date of Patent: Oct. 31, 2000

[54] IGNITION SYSTEM AND PRINCIPLE OF OPERATION

[75] Inventor: Ludwig Juffinger, Thiersee, Austria

[73] Assignee: Ficht GmbH & Co. KG, Kirchseeon, Germany

[21] Appl. No.: 09/297,291

[22] PCT Filed: Oct. 28, 1997

[86] PCT No.: PCT/EP97/05950

§ 371 Date: Jul. 2, 1999

§ 102(e) Date: Jul. 2, 1999

[87] PCT Pub. No.: WO98/19066

PCT Pub. Date: May 7, 1998

[30] Foreign Application Priority Data

Oct. 29, 1996 [DE] Germany ..... 196 43 785

[51] Int. Cl.[7] ..... F02P 1/00

[52] U.S. Cl. ..... 123/598; 123/620; 123/644

[58] Field of Search ..... 123/620, 598, 123/644, 605

[56] References Cited

U.S. PATENT DOCUMENTS

| | | | |
|---|---|---|---|
| 4,261,025 | 4/1981 | Chafer et al. | 123/598 |
| 4,341,195 | 7/1982 | Nishio et al. | 123/598 |
| 4,462,380 | 7/1984 | Asik | 123/620 |
| 5,179,928 | 1/1993 | Cour et al. | 123/620 |
| 5,309,888 | 5/1994 | Deutsch et al. | 123/644 |
| 5,471,362 | 11/1995 | Gowan | 123/598 |
| 5,568,801 | 10/1996 | Paterson et al. | 123/620 |
| 5,621,278 | 4/1997 | Chambers | 123/620 |

*Primary Examiner*—John Kwon

*Attorney, Agent, or Firm*—Fletcher, Yoder & Van Someren

[57] ABSTRACT

An electric ignition device for an internal combustion engine having a primary and a secondary circuit coupled together by a transformer. The secondary circuit includes a spark gap. The primary circuit includes a capacitor that can be discharged. The voltage discharged by the capacitor is coupled by the transformer to the secondary circuit where it produces an ignition spark across the spark gap. The primary circuit is a resonant circuit that is repeatedly excited keeping the ignition spark burning as an arc. Current or voltage in the secondary circuit are detected to control the energy introduced into the spark gap.

22 Claims, 3 Drawing Sheets

IGNITION SYSTEM AND PRINCIPLE OF OPERATION

Figure 1:
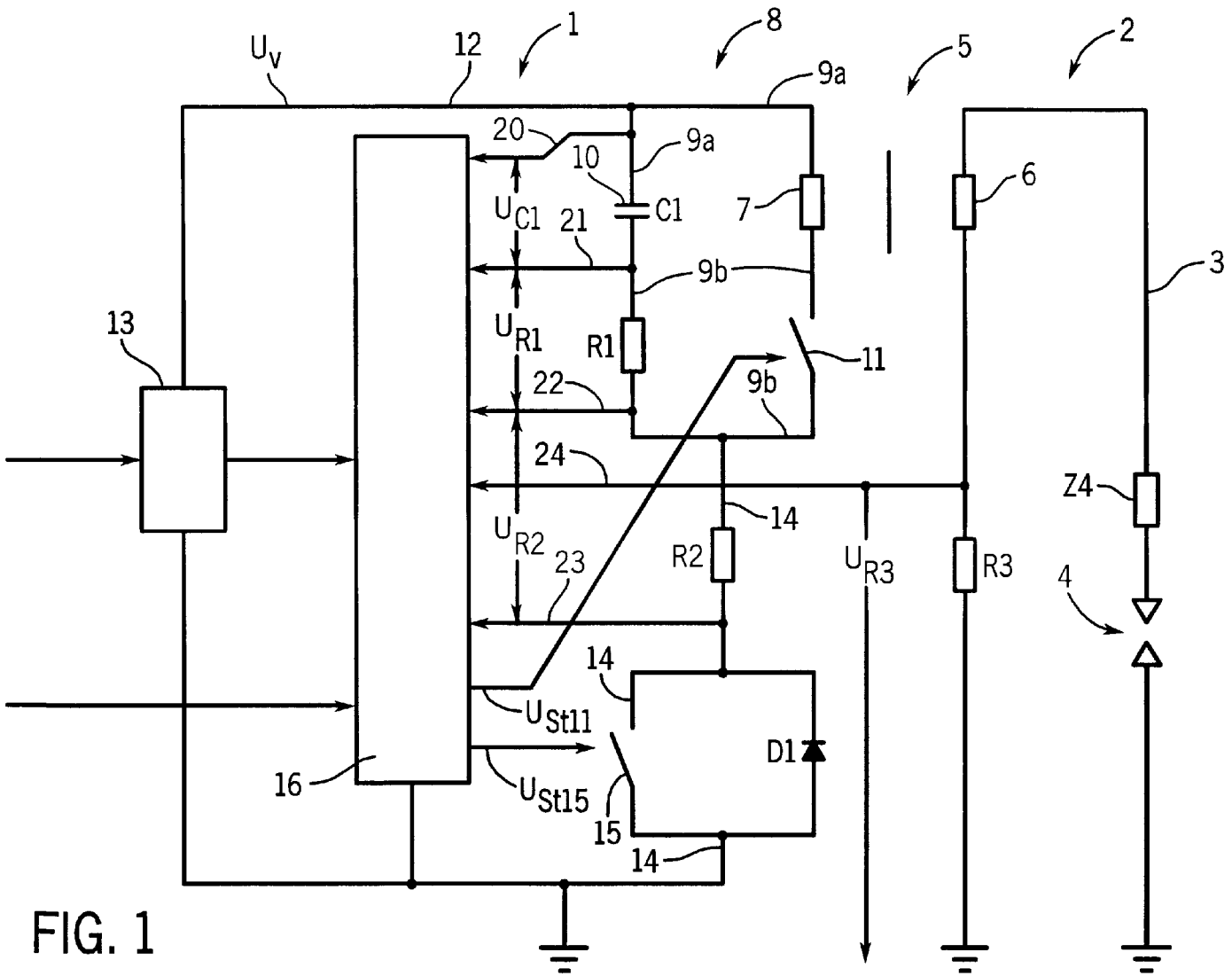

The invention relates to an electric ignition device according to the preamble of Claim 1 and to a method for operating an ignition device.

Such ignition devices are used for igniting fuel-air mixtures in internal combustion engines. Fuel-air mixtures which have a stoichiometric ratio require little igniting energy and burn up reliably. However, internal combustion engines are increasingly being operated with lean mixtures, as a result of which the fuel consumption and the emission of pollutants can be drastically reduced. Such lean fuel-air mixtures require higher igniting energies and a longer lasting ignition spark in order to ensure reliable ignition of the fuel-air mixture.

Furthermore, particular ignition problems arise in the case of special applications such as, for example, in engines for motor boats. Thus, the air-fuel mixture can be ignitable only with difficulty because of moisture components, or soot particles which impair the ignition collect in an idling operation of relatively lengthy duration.

Ignition problems arise with internal combustion engines particularly in the case of low speeds and during the starting operation.

Fundamentally, two types of ignition devices are known, specifically inductive ignition devices (Coil Ignition=CI) and capacitive ignition devices (Capacitive Discharge Ignition=CDI). Capacitive ignition devices are distinguished by a high ignition voltage and a rapid ignition voltage rise, with the result that an ignition spark can be produced even in the case of non-ideal spark gaps. However, the intensive ignition spark of a capacitive ignition device is only very short-lasting, with the result that poorly flammable mixtures often cannot be ignited.

Inductive ignition devices, by contrast, produce a relatively long-lasting ignition spark, it being the case, however, that the maximum ignition voltage is substantially lower than in the case of capacitive ignition devices.

WO 93/04279 has disclosed an ignition device in which two energy sources are used in order to produce an ignition spark which has a high ignition voltage and, at the same time, is relatively long-lasting. In this case, a distinction is drawn between the actual spark, to produce which a high voltage is required, and the arc following thereupon, which is kept burning by means of a relatively low voltage.

This ignition device has an inherently conventional design with a primary capacitor which serves as first energy source or energy store and is arranged in a primary circuit. The primary circuit is coupled via a transformer to a secondary circuit in which a spark plug is provided. The primary capacitor is charged by means of a current source to a predetermined voltage value, and discharged suddenly by means of a trigger device. The discharging pulse is coupled into the secondary circuit via the transformer and causes a high voltage pulse for producing a spark at the spark plug or spark gap. To this extent, this ignition device corresponds to a conventional capacitive ignition device.

Moreover, as a second energy source a secondary capacitor is connected in series with the spark plug in the secondary circuit. This secondary capacitor is charged via the same current source as the primary capacitor or via a further current source, the secondary capacitor subsequently being discharged at the spark produced by the primary capacitor, since the secondary circuit is closed by the formation of a plasma in the spark gap. The arc is kept burning by the second energy source, the secondary capacitor.

Furthermore, U.S. Pat. No. 4,083,347 and U.S. Pat. No. 4,506,650 have disclosed further ignition devices which contain additional electronic subassemblies in the secondary circuit in order to maintain a pulsed or capacitive ignition with a high ignition voltage over a lengthy period.

Because of the high voltages (>3000 V) and high currents (>250 mA) occurring in the secondary circuit, it is not possible, or is possible only with an exceptionally high technical outlay, for additional energy to be fed into the secondary circuit, or to provide electronic subassemblies, in particular semiconductor components.

DE 30 33 367 A1 discloses a circuit for raising the intensity and duration of the ignition spark which can be supplied by an ignition coil, said circuit having a resonant circuit which contains a charging capacitor and an ignition coil and which is excited by means of a transistor circuit after the ignition of an ignition spark in such a way that the ignition spark is kept burning.

DE 37 14 155 A1 (=U.S. patent application Ser. No. 857,299 dated Apr. 30, 1986), DE-A 20 48 960 and U.S. Pat. No. 4,677,960 disclose circuits by means of which it is possible in each case to produce a sequence of rapidly succeeding ignition sparks. These circuits do not permit the ignition spark to burn as long as desired.

It is the object of the invention to create an ignition device which is of simple design and yet renders possible an ideal igniting pulse. Furthermore, it is the object of the invention to create for the purpose of operating an ignition device a method which both ensures a reliable ignition operation and is simple to carry out.

The object is achieved by means of a device having the features of Claim 1 and a method having the features of Claim 12.

Advantageous refinements of the invention are specified in the subclaims.

Like the known capacitive ignition devices, the ignition device according to the invention is constructed from a primary and a secondary circuit which are coupled to one another via a transformer, a capacitor being arranged in the primary circuit. The capacitor can be discharged suddenly in order to produce an ignition spark.

According to the invention, the capacitor is a constituent of a resonant circuit, with the result that unconsumed energy is charged back again into the capacitor upon the production of the ignition spark. In addition, provision is made of a device for repeatedly exciting the resonant circuit and by means of which the capacitor is supplied with additional energy, preferably during "charging back" and "oscillating back". As a result, the resonant circuit is kept oscillating near its natural frequency, and so an alternating current which keeps the ignition spark burning as an arc is fed into the secondary circuit. In addition, the current flowing in the secondary circuit and/or the voltage present in the secondary circuit is detected and of the current [sic] of the secondary circuit or the quantity of energy introduced into the spark gap are controlled to a predetermined constant value in accordance with the detected current and/or the detected voltage.

As a result, on the one hand reliable ignition even of very lean fuel-air mixtures is ensured by the ignition spark, which burns as long as desired and, on the other hand, the consumption of electric energy is prevented from rising exorbitantly, as is usual with conventional ignition devices which are also intended to ignite lean mixtures. The invention therefore for the first time permits lean-burn engines to be ignited in a way which saves energy.

Figure 3:
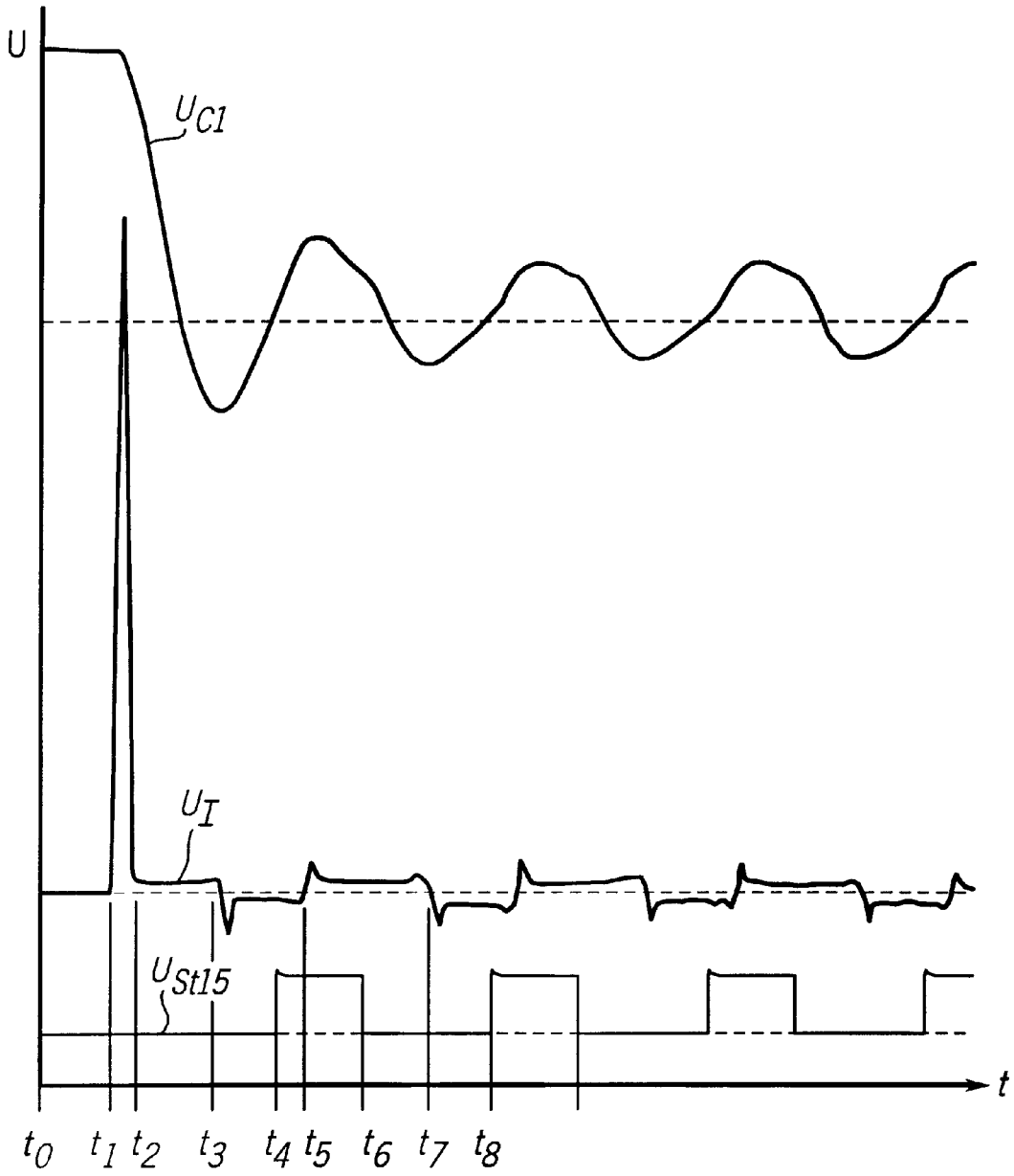

The invention is explained in more detail by way of example with the aid of a drawing, in which:

FIG. 1 shows the device according to the invention, in a diagrammatically simplified circuit diagram, FIGS. to 2*a* to 2*h* show the charging states in the resonant circuit, in a diagrammatically simplified representation, and FIG. 3 shows an ignition operation diagrammatically with the aid of the capacitor voltage, a control signal for a switch and an ignition voltage tapped at the spark plug.

The ignition device according to the invention has a primary circuit 1 and a secondary circuit 2.

The secondary circuit 2 essentially comprises only an ignition lead 3, a spark plug 4 and the secondary side f a transformer 5 with its secondary coil 6. Furthermore, conventional interference suppression elements (not represented) are provided in the secondary circuit. In FIG. 1, Z4 denotes a complex resistance in the secondary circuit 2, which represents the total resistance of all the elements in the secondary circuit.

The primary circuit 1 is coupled o the secondary circuit 2 via the transformer 5, which has a primary coil 7 in the primary circuit and the secondary coil 6 in the secondary circuit. The transfer ratio [sic] from the primary to the secondary side is, for example, approximately 1:100, which means that the voltage on the secondary side is approximately one hundred times as high as that on the primary side. The primary coil 7 is a constituent of a resonant circuit 8 in which a capacitor 10 and a discharging switch 11 is [sic] arranged.

The resonant circuit 8 has two line sections 9*a*, 9*b* which in each case connect the capacitor 10 to the primary coil 7. One of the two line sections 9*a* is connected via a supply line 12 to a terminal of a current source 13, with the result that a supply voltage $U_V$ is present at the line section 9*a*. The other line section 9*b* is connected via a further supply line 14 to the other terminal of the current source 13, a charging switch 15 being arranged in the supply line 14. The supply line 14 is connected to frame. A diode D1 which connects the line section 9*b* to frame is arranged in parallel with the charging switch 15.

The discharging and charging switches 11, 15 are actuated by a control device 16 by means of control voltages $U_{St11}$, $U_{St15}$, which controls the discharging of the capacitor 10 and the excitation of the resonant circuit 8 in accordance with a trigger signal and with the voltage and/or current states present in the ignition device. Three measuring shunts R1, R2 and R3 are provided for detecting the individual voltage and/or current states. The measuring shunt R1 is arranged in the line section 9*b* of the resonant circuit 8, specifically in the region between the capacitor 10 and the connecting point to the supply line 14. The measuring shunt R2 is arranged in the supply line 14, and the measuring shunt R3 is arranged in the ignition lead 3 in the secondary circuit 2.

Provided at the primary circuit 1 are four measuring lines 20, 21, 22, 23 for tapping the voltages which are present at the capacitor 10 and the measuring shunts R1 and R2 and which are fed to the control device 16. The measuring line 20 is connected to the resonant circuit 8 on the side of the capacitor 10 directed towards the power supply. The measuring line 21 is connected to the resonant circuit 8 in the region between the capacitor 10 and the measuring shunt R1, and the measuring line 22 is connected to the line section between the measuring shunt [sic] R1 and R2. The measuring line 23 is connected to that side of the measuring shunt R2 which is connected to frame. The measuring line 24 is connected to the secondary circuit 2 or the ignition lead 3 thereof in the region between the secondary coil 6 of the transformer 5 and the measuring shunt R3.

The capacitor voltage $U_{C1}$, which represents a measure of the current charging state of the capacitor 10, is tapped between the two measuring lines 20, 21, which are arranged on both sides of the capacitor 10. The measuring lines 21, 22 arranged on both sides of the measuring shunt R1 tap the voltage $U_{R1}$ which is present at the measuring shunt R1 and which represents a measure of the current $I_P$ flowing in the resonant circuit 8. The measuring lines 22, 23 arranged on both sides of the measuring shunt R2 tap the voltage $U_{R2}$ which is present at the measuring shunt R2 and is a measure of the charging current flowing through the supply line 14.

The measuring line 24 connected to the secondary circuit 2 taps the voltage $U_{R3}$ which is present with respect to frame at the measuring shunt R3 and which represents a measure of the current $I_S$ flowing in the secondary circuit 2.

The mode of operation of the ignition device according to the invention is explained below with the aid of FIGS. 2*a* to 2*h*.

Figure 2A:
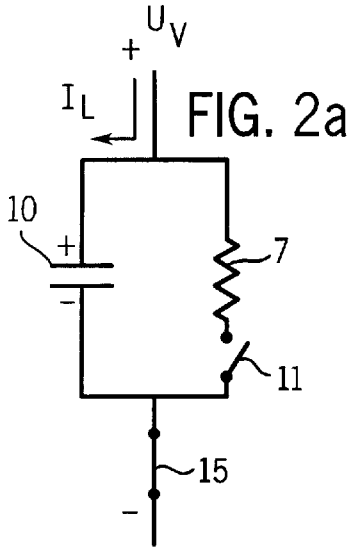
Figure 2B:
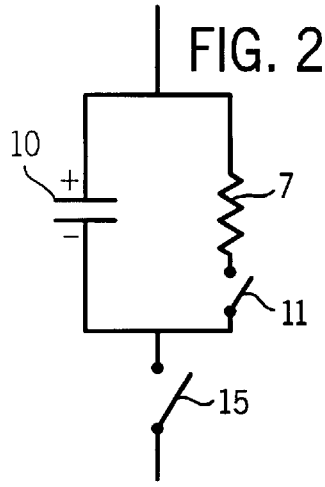
Figure 2C:
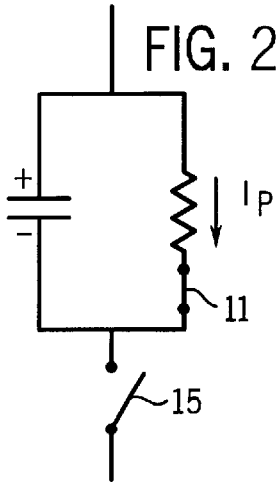
Figure 2D:
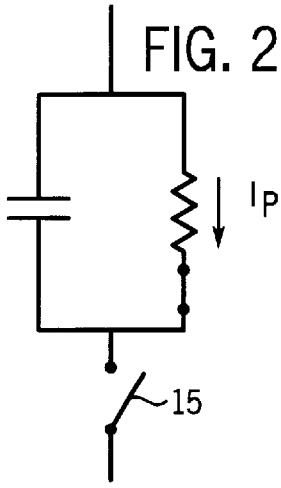

During an ignition-free period, the capacitor 10 is charged with a charging current $I_{[L]}$by closing the charging switch 15 (FIG. 2*a*). In this case, the charging switch is open, with the result that the supply voltage $U_V$ is present directly at the capacitor 10.

A supply voltage $U_V$ which is positive with respect to frame is specified in the model of the resonant circuit represented diagrammatically in FIGS. 2*a* to 2*h*. The charging switch 15 is opened (FIG. 2*b*) if the capacitor voltage $U_{C1}$ has reached a predetermined value. The capacitor 10 is therefore in its charged state.

If a trigger signal, which indicates the initiation of an ignition spark, arrives at the control device 16, the discharging switch 11 is closed (FIG. 2*c*), with the result that the resonant circuit 8 is closed and the capacitor 10 discharges. If the charging switch 15 is not yet open, the same is also opened, even if the capacitor voltage has not yet reached its predetermined value. By discharging the capacitor 10, a current pulse $I_P$ is generated which flows through the primary coil 7 of the transformer. The current pulse is directed in a clockwise fashion in the resonant circuit represented in FIG. 2*c*. It is transmitted through the transformer 5 to the secondary side, the electric voltage being multiplied, with the result that an ignition voltage sufficient for ignition is present at the spark plug 4 or the corresponding spark gap.

However, in this case, because of the magnetic field built up in the primary coil 7, a residual energy remains stored in the primary circuit 1. The capacitor is recharged again contrary to the original polarity shown in FIGS. 2*a*,

2*b* (FIGS. 2*d*, 2*e*) by the decay of the magnetic field (FIG. 2*d*) in the primary coil 7 after the capacitor 10 is discharged. When the magnetic field in the primary coil 7 decays (FIG. 2*e*), the charge stored in the capacitor oscillates "back" again (FIG. 2*f*), the capacitor 10 discharging and again generating a current pulse in the primary coil 7. This "back-oscillating" current $I_P$ flows anticlockwise in the resonant circuit shown in FIG. 2*f*, the current pulse $I_P$ being transmitted trough the transformer 5 into the secondary circuit 2 and generating a voltage pulse there. As a result, residual energy is stored in turn in the primary coil 7, which decays again after discharging of the capacitor 10 and recharges the capacitor again with the original polarity. This energy or electric charge stored in the capacitor is strongly reduced by comparison with the originally stored energy, because of the energy transmitted into the secondary circuit 2 and because of the electric resistances in the primary circuit 1.

Consequently, according to the invention, during the renewed recharging of the capacitor, the charging switch 15 is briefly closed by the current pulse $I_P$ oscillating back because of the natural oscillatory response of the resonant circuit 8, with the result that the capacitor 10 is recharged by the charging current $I_L$ in addition to the "back-oscillating charging" by the power supply. The charging level at the capacitor 10 is raised hereby and the voltage $U_{C1}$ is increased.

Figure 2E:
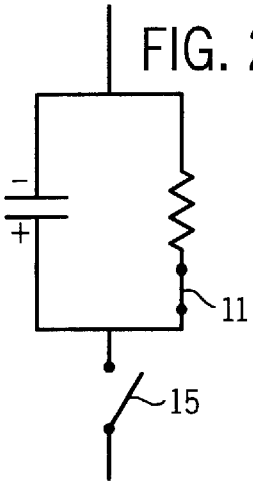
Figure 2F:
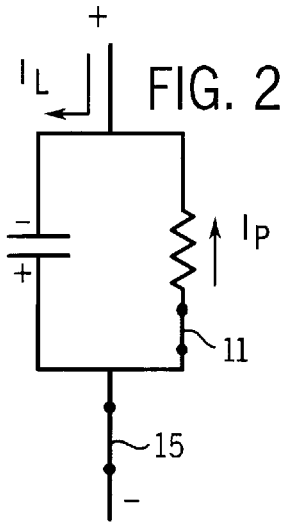
Figure 2G:
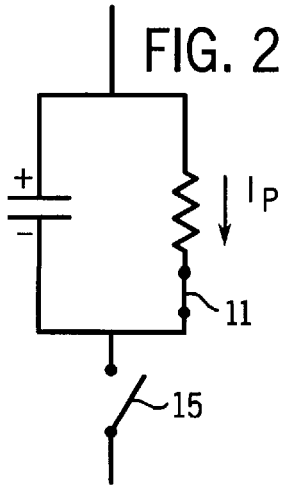

This additional charging of the capacitor 10 via the power supply is preferably performed whenever the current direction reverses with reference to the first discharging operation (FIGS. 2*c*, 2*d*) (FIGS. 2*e*, 2*f*). That is to say, from the instant from which the capacitor 10 has its maximum electric charge with opposite polarity by comparison with the original polarity or that produced by the charging current, the capacitor 10 can be recharged by closing the charging switch 15 from outside the resonant circuit 8, this additional charging operation preferably being terminated at the latest when the current direction reverses again.

This additional recharging of the capacitor 10 can be performed in the case of each "oscillating back", with the result that the resonant circuit 8 is kept continuously oscillating. A resonant circuit continuously oscillating in this way continuously transmits via the transformer 5 an AC voltage by means of which a spark produced at the spark plug 4 is kept burning as an arc.

The additional recharging of the capacitor 10 during the "oscillating back" is a deliberate excitation of the resonator circuit near its natural frequency. The regular excitation by closing the charging switch 15 causes a change in the total impedance of the resonant circuit, with the result that the natural frequency varies accordingly. The instant of the excitation is preferably fixed with the aid of the capacitor voltage $U_{C1}$ picked up or the measuring voltage $U_{R1}$ tapped at the measuring shunt R1. If the capacitor voltage $U_{C1}$ has a polarity which is the reverse of the original polarity, and if the measuring voltage $U_{R1}$ tapped at the measuring shunt R1, and thus the current in the resonant circuit, is equal to zero, this means that the "oscillating back" starts and the excitation of the resonant circuit can be started by closing the charging switch 15. The additional charging operation or the excitation of the resonant circuit is expediently terminated at the latest when the capacitor voltage $U_{C1}$ again has the original polarity and the voltage $U_{R1}$ tapped at the measuring shunt R1 is equal to zero. These two instants ($U_{C1}<0$ and $U_{R1}=0$; $U_{C1}>0$ and $U_{R1}=0$) bound the time interval, and meanwhile the current in the resonant circuit 8 is directed counter to the direction of the first discharging operation.

An excitation of the resonant circuit can also be performed partly outside this time interval, it being the case, however, here that the efficiency is worse than for a complete excitation within this time interval.

An igniting operation according to the invention is represented in FIG. 3 with the aid of the capacitor voltage $U_{C1}$, the control voltage $U_{St15}$ for actuating the charging switch 15, and an ignition voltage $U_I$ tapped at the spark plug, the individual voltages being plotted against time t. Salient instants are marked on the time axis t by $t_0$, $t_1$, . . . .

At the instant $t_0$, the capacitor voltage is approximately 300 V. At the instant $t_1$, the discharging switch 11 is closed, with the result that the voltage $U_{C1}$ drops abruptly across the capacitor, and the voltage at the spark plug 4 rises suddenly up to the instant $t_2$. At the instant $t_2$, an ignition spark is produced at the spark plug, with the result that a plasma is built up at the spark gap and the resistance of the spark gap is reduced suddenly. The voltage $U_I$ present at the spark plug 4 hereby drops to a relatively low value. With this relatively low voltage $U_I$, the ignition spark continues to burn as an arc. At the instant $t_3$, the capacitor voltage $U_{C1}$ has reached its minimum (negative maximum) of approximately −100 V, with the result that at this instant the current direction in the resonant circuit 8 reverses and the capacitor voltage $U_{C1}$ increases again. The instant $t_4$ represents the zero crossing of the capacitor voltage $U_{C1}$, that is to say the capacitor voltage $U_{C1}$ is equal to zero at the instant $t_4$. With the zero crossing of the voltage $U_{C1}$, the charging switch 15 is closed, that is to say a voltage pulse of the control voltage $U_{St15}$ is emitted, and the excitation of the resonant circuit is started. The instant up to starting the excitation of the resonant circuit or to starting the additional charging operation of the capacitor 10 can also be selected earlier, it preferably being advanced only up to the instant $t_3$ at which the current direction in the resonant circuit reverses.

The capacitor voltage $U_{C1}$ reaches a maximum at the instant $t_5$. The current direction in the resonant circuit 8 reverses again, with the result that the voltage $U_{C1}$ drops again across the capacitor. The charging operation is, however, continued here beyond the instant $t_5$ up to an instant $t_6$, in order to introduce a sufficient quantity of energy in the resonant circuit 8. The capacitor voltage drops as far as the next minimum at $t_7$, an additional charging operation being started at $t_8$ at the zero crossing following thereupon. Fundamentally, this can be repeated as often as wished, so that the ignition spark is kept burning as an arc. Because of the varying plasma and the interference-suppression elements, the profile of the voltage $U_I$ on the secondary side does not correspond exactly to the sinusoidal profile fed from the primary side into the secondary side. However, an approximately square-wave AC voltage with which the arc is kept burning is to be seen. On the primary side, the amplitude of the AC voltage maintained by the excitation is approximately 60–100 V. It is approximately one quarter to one third of the original charging voltage of 300 V.

The duration of the repeating pulses of the control voltage $U_{St15}$ determines the energy which is fed. In a simple embodiment, the pulse duration is set to a predetermined value so that the pulses in each case have the same quantity of energy.

However, it can also be expedient to control the current $I_S$ to a predetermined value. For this purpose, the control device 16 evaluates the voltage signal tapped on the measuring line 24, which is a measure of the current $I_S$ in the secondary circuit 2. If the voltage signal is higher than a predetermined threshold value, the pulse duration of the control voltage $U_{St15}$ is shortened, whereas the pulse duration is lengthened if the measured voltage signal is below a predetermined value.

In the embodiment according to the invention, for the purpose of determining the pulse duration the energy input introduced in the spark gap is detected, for example by tapping the voltage $U_{R3}$ and the two voltages $U_{C1}$ and $U_{R1}$. The sum of the voltages $U_{C1}$ and $U_{R1}$ corresponds essentially to the voltage present at the primary coil 7. In order to determine the energy flow [Joules/second] introduced in the spark gap, the sum of the voltages $U_{C1}$ and $U_{R1}$ is multiplied by the gain of the transformer in order in this way to estimate the voltage present on the spark gap. Since the voltage present on the secondary circuit 2 and the current flowing therein (corresponds to $U_{R3}$) are therefore known, the energy introduced per pulse into the spark gap, and thus the energy flow, can be calculated, and the pulse duration can be controlled as a function of the energy flow introduced. Instead of estimating the voltage via the voltage $U_{C1}$ and $U_{R1}$, the voltage can be measured by an additional measuring coil (known per se) which is arranged between the primary and the secondary coils 7, 6. The current flowing in the secondary circuit 2 can also be measured indirectly by the voltage dropping across the resistor R1.

The diode D1 arranged in parallel with the charging switch 15 causes the potential of the line section 9*b* referred to frame to be not smaller than approximately −1 volt. This ensures that no relatively large negative potential builds up on the line section 9*b*, and thus that no large potential difference arises between the supply voltage $U_V$ and the line section 9*b*. As a result, it is easier to realize the discharging switch 11 by means of semiconductor elements.

The ignition device according to the invention has substantial advantages by comparison with conventional ignition devices:

1. The secondary side, on which the high voltage is present, is of very simple construction without expensive electronic subassemblies.
2. The energy is fed with high efficiency, since the energy supply is oriented to the natural frequency of the resonant circuit.
3. The ignition spark can theoretically be kept burning as an arc for as long as desired.
4. Since the excitation of the resonant circuit is performed as a function of specific measured variables such as, for example, the capacitor voltage $U_{C1}$ and the current in the resonant circuit, the ignition device according to the invention adjusts automatically to changing parameters which influence the natural frequency of the resonant circuit. Such changes occur essentially from aging of the subassemblies in the secondary circuit, which react on the primary circuit.
5. By comparison with conventional ignition devices, the construction of the ignition device according to the invention essentially represents only a modification on the primary side, which can be carried out simply and cost-effectively and can be retrofitter.
6. The ignition device according to the invention permits the energy expended on the spark gap to be monitored, with the result that the energy can be fed in an exactly dosed fashion.
7. A short spark burning life can be selected for a mixture which can ignite effectively, with the result that, as in the case of conventional capacitive ignition devices, the ignition spark is produced solely by a single voltage pulse.

The device according to the invention can also very advantageously be used to ignite gas discharge lamps. The quantity of the ignition energy which is fed influences the service life of such a gas discharge lamp. Repeated instances of faulty ignition lead to rapid aging. With ignition devices according to the invention, the ignition energy is controlled in a simple way to a minimum requirement necessary for ignition, with the result that the known disadvantages of conventional ignition devices can be avoided.

In addition, with the ignition device according to the invention it is not only possible to improve the ignition of a gas discharge lamp, but energy which has been fed can also be controlled during burning of the gas discharge lamp, with the result that the lamp emits a specific light spectrum, for example independently of temperature.

Furthermore, the ignition device according to the invention can be used to perform self-diagnosis without an additional sensor.

What is claimed is:

1. An electric ignition device, in particular for internal combustion engines, comprising:

a primary circuit, electrically connected as a resonant circuit, including a capacitor, a coil, and a control device;

a secondary circuit, including a spark plug for igniting a fuel-air mixture;

a charging device for charging the capacitor to a predetermined charging voltage;

a transformer for transmitting an electric igniting pulse generated by discharging the capacitor from the primary circuit into the secondary circuit; and a device for detecting the current ($I_S$) or the voltage ($U_1$) in the secondary circuit, wherein the resonant circuit is repeatedly excitable in order to keep burning as an arc an ignition spark produced by discharging the capacitor, and further wherein, the current ($I_S$) or an energy flow introduced into the secondary circuit is controlled to an approximately constant value in accordance with the detected current ($I_S$) or the detected voltage ($U_1$) by the control device.

2. The electric ignition device according to claim 1, wherein the device for detecting the current ($I_S$) has a resistor arranged in the secondary circuit, and the control device is connected to a measuring line for tapping the voltage ($U_3$) dropping across the resistor, which is proportional to the current ($I_S$).

3. The electric ignition device according to claim 1, wherein the device for detecting the voltage ($U_1$) has a measuring coil which is disposed in the transformer between a primary and secondary coil and across which a voltage proportional to the voltage in the secondary circuit drops.

4. The electric ignition device according to claim 1, wherein the transformer has a primary coil and a secondary coil, the primary coil being the coil of the resonant circuit.

5. The electric ignition device according to claim 1, further comprising a discharging switch in the resonant circuit that is actuateable by the control device.

6. The electric ignition device according to claim 1, wherein the resonant circuit has two line sections connected between the coil to the capacitor, each line section connected via a supply line to a terminal of a power supply, and at least one supply line connected via a charging switch actuateable by the control device.

7. The electric ignition device according to claim 6, further comprising a measuring shunt in one of the supply lines, the voltage drop across the measuring shunt being a measure of charging current ($I_L$) flowing through the supply lines.

8. The electric ignition device according to claim 1, further comprising a measuring shunt in the resonant circuit, the voltage drop across the measuring shunt constituting a measure of current ($I_P$) flowing in the resonant circuit.

9. The electric ignition device according to claim 1, wherein the control device is connected to measuring lines for tapping voltage ($U_{C1}$) present at the capacitor.

10. The electric ignition device according to claim 7, wherein the control device measures voltage drop across the measuring shunt in the supply line.

11. The electric ignition device according to claim 8, wherein the control device measures voltage drop across the measuring shunt in the resonant circuit.

12. A method for operating an ignition device, the ignition device having a primary circuit electrically connected as a resonant circuit with a capacitor and a coil and which is coupled by a transformer to a secondary circuit in which a spark plug having a spark gap is arranged, comprising the steps of:

producing an ignition spark at the spark plug by discharging the capacitor;

maintaining the ignition spark burning as an arc by repeatedly feeding energy pulses from outside to the resonant circuit;

detecting current or voltage in the secondary circuit; and controlling current in the secondary circuit or energy flow introduced into the spark gap to a predetermined constant value in accordance with the detected current or the detected voltage.

13. The method according to claim 12, wherein the control of the current in the secondary circuit or the energy flow introduced into the spark gap is performed by varying the energy pulse duration.

14. The method according to claim 12 or 13, wherein the current in the secondary circuit is detected by a resistor in the secondary circuit, across which a voltage proportional to the current drops.

15. The method according to claim 12, wherein voltage in the secondary circuit is detected by a measuring coil disposed between a primary coil and a secondary coil of the transformer.

16. The method according to claim 12, wherein the voltage of the secondary circuit is measured by detecting the voltage present at a primary coil of the transformer and multiplying the voltage by a gain of the transformer.

17. The method according to claim 12, wherein the resonant circuit is fed the energy pulses from outside in the form of current pulses.

18. The method according to claim 17, wherein the current pulses fed from outside recharge the capacitor, and further wherein the current pulses fed from outside are directed in the same direction as the current respectively flowing in a region of the capacitor in the resonant circuit, such that the current pulses fed from outside are added to current flowing in the resonant circuit.

19. The method according to claim 18, wherein the feeding of a current pulse into the resonant circuit is started with a reversal of the current direction in the resonant circuit.

20. The method according to claim 18, wherein feeding a current pulses into the resonant circuit is terminated at the latest with a reversal in the current direction in the resonant circuit.

21. The method according claim 12, wherein a number of the energy pulses or a time period during which energy pulses are fed to the resonant circuit after discharging the capacitor is limited to a predetermined value.

22. An electric ignition device, in particular for internal combustion engines, comprising:

a primary circuit, electrically connected as a resonant circuit, including a capacitor, a coil, and a control device;

a secondary circuit, including a spark plug for igniting a fuel-air mixture;

a charging device for charging the capacitor to a predetermined charging voltage;

a transformer for transmitting an electric igniting pulse generated by discharging the capacitor from the primary circuit into the secondary circuit; and a device for detecting the current ($I_S$) or the voltage ($U_1$) in the secondary circuit, wherein the resonant circuit is repeatedly excitable in order to keep burning as an arc an ignition spark produced by discharging the capacitor, and further wherein, the current ($I_S$) or an energy flow introduced into the secondary circuit is controlled to an approximately constant value in accordance with the detected current ($I_S$) and the detected voltage ($U_1$) by the control device.

* * * * *